US005685669A

United States Patent [19]

Lewiński et al.

[11] Patent Number: 5,685,669

[45] Date of Patent: Nov. 11, 1997

[54] MINING ROOF SUPPORT

[75] Inventors: Tadeusz Lewiński, Zagórzany; Leszek Jarno, Bytom; Antoni Trojan, Gorlice; Jerzy Moskal, Kryg; Marian Bednarz, Libusza; Mieczysław Godkowicz, Sekowa; Józef Belniak, Gorlice; Piotr Konieczny, Gorlice; Stanisław Zabierowski, Gorlice; Stanisław Koryga, Gorlice, all of Poland

[73] Assignee: Fabryka Maszyn"Glinik" S.A., Michalusa, Poland

[21] Appl. No.: 588,208

[22] Filed: Jan. 19, 1996

[30] Foreign Application Priority Data

Jan. 23, 1995 [PL] Poland ..... 306 924

[51] Int. Cl.[6] ..... E21D 15/44

[52] U.S. Cl. ..... 405/291; 405/295; 405/288

[58] Field of Search ..... 405/288, 290, 405/291, 293, 295, 296, 297; 299/11, 33

[56] References Cited

U.S. PATENT DOCUMENTS

| | | | |
|---|---|---|---|
| 4,382,722 | 5/1983 | Romanowicz et al. | 405/291 |
| 4,629,368 | 12/1986 | Hill | 405/291 X |
| 4,784,532 | 11/1988 | Priscott | 405/296 |

FOREIGN PATENT DOCUMENTS

| | | | |
|---|---|---|---|
| 2924210 | 12/1980 | Germany | 405/291 |
| 3121423 | 5/1982 | Germany . | |
| 297115 | 12/1992 | Poland . | |
| 1155769 | 5/1985 | U.S.S.R. | 405/291 |
| 1157253 | 5/1985 | U.S.S.R. | 405/291 |

*Primary Examiner*—Tamara L. Graysay
*Assistant Examiner*—Frederick L. Lagman
*Attorney, Agent, or Firm*—Ladas & Parry

[57] ABSTRACT

A roof support having a stabilizing-guiding system for two spaced articulated quadrilateral linkages joined by a spacer element. The stabilizing-guiding system includes two coordinating links respectively, pivotably connected at one of the ends thereof to the canopy and the bottom sprag and at their other ends the links are connected together by a connecting element. The connecting element is supported in a guideway fixed to the spacer element. Hydraulic legs are connected to the bottom sprag rearwardly of a plane bounding a walkway space for the crew on the bottom sprag.

7 Claims, 2 Drawing Sheets

MINING ROOF SUPPORT

FIELD OF THE INVENTION

The invention relates to a mining roof support designed for mechanization of mining work, mainly in coal mining.

DESCRIPTION OF PRIOR ART

German patent application no 312423 discloses a roof support, in which the canopy is guided in relation to the bottom sprag and stabilized by means of a system of two link parallelograms with one common link element. In this design, the support extension and holding up of the canopy are effected by means of rams situated in accordance with the direction of the diagonals in the parallelograms of the guidance and stabilization system. In the case of simultaneous feeding of all of the lifting rams, vertical movement of the canopy tip is obtained within the whole range of operation. There is also the possibility to obtain horizontal movements of the canopy by feeding the upper and lower lifting rams separately.

There is also known a roof support from the Polish patent application no. P-297115, in which the canopy is linked with the bottom sprag by means of a supporting-stabilizing-guiding system in the form of two spacial quadrilaterals joined by a spacer element. In the diagonals of the quadrilaterals, there are lifting rams. By linking the quadrilaterals with a spacer element in a form similar to an isosceles triangle, good utilizable features can be obtained.

SUMMARY OF THE INVENTION

An object of this invention is the development of a roof support with simplified assembly of the hydraulic legs and with vertical movement of the canopy. In the roof support according to this invention, the stabilizing guiding system is fitted with the coordinating links rotatably connected to the elements of the canopy and bottom sprag, preferably by articulated joints of the front links with the canopy and bottom sprag. The other ends of the coordinating links are rotatably connected by means of the linking element, which simultaneously cooperates with the longitudinal guideways durably integrated with the spacer elements Joining the articulated quadrilaterals. Longitudinal guideways are situated with their main axis parallel to the bottom sprag plane. The coordinating links and the front links in the quadrilaterals from the acute angles.

The hydraulic legs are situated perpendicular to the bottom sprag plane or sloped towards the face, operate in conjunction with the canopy and bottom sprag and are seated in the bottom sprag at points located rearwardly of the plane limiting the walkway for the crew on the bottom sprag on the side of the stabilizing - guiding system. It is advantageous to locate the hole centers for pin connections of the links in the spacer elements at the vertexes of an isosceles triangle or trapezoid. The design solution according to this invention allows for the functional construction of the roof support with good utilizable parameters. The canopy of the roof support is guided within the whole range of operation, which allows constant shielding of the excavation roof to be effected. The width of the walkway for the crew also has a constant value within the whole range of the roof support operation. This positive feature essentially improves the difficult work conditions. Particularly, this utilizable feature distinguishes the subject roof support from the commonly used lemniscate support, in which, there may occur partial closing of the walkway space for the crew, by the inclined legs in the lower ranges of operation. Location of the stabilization and guidance system and hydraulic legs in the same space allows the bottom sprag and canopy to be shortened and this in turn enables considerable decrease of the roof support weight. In the case when the hydraulic legs are situated vertically, the roof support has constant load within the whole range of operation.

BRIEF DESCRIPTION OF THE DRAWING

The invention is illustrated by an example in the drawing, in which FIG. 1. shows the support in partial cross section illustrating the structure of the longitudinal guideways in the spacer elements, and FIG. 2. shows the support from the face side.

DETAILED DESCRIPTION OF A PREFERRED EMBODIMENT

Figure 1:
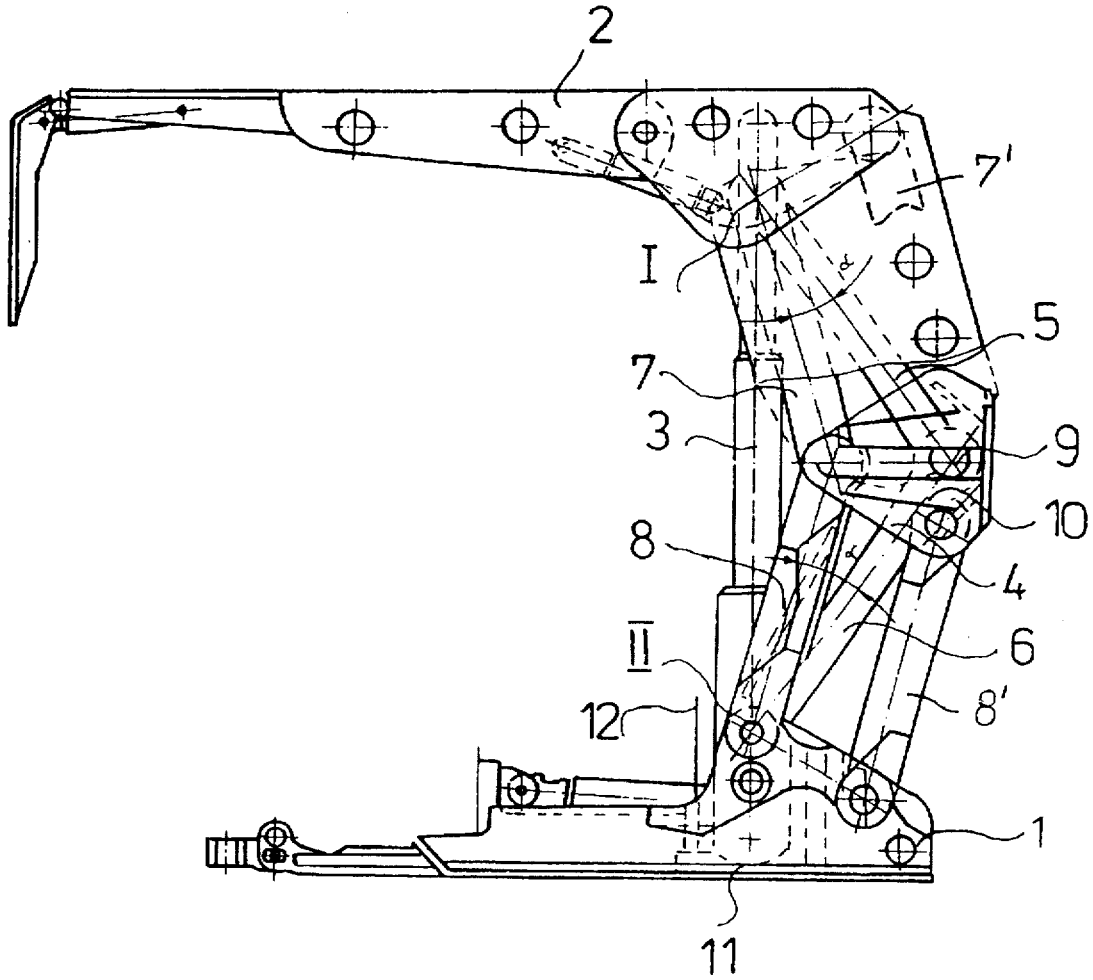
Figure 2:
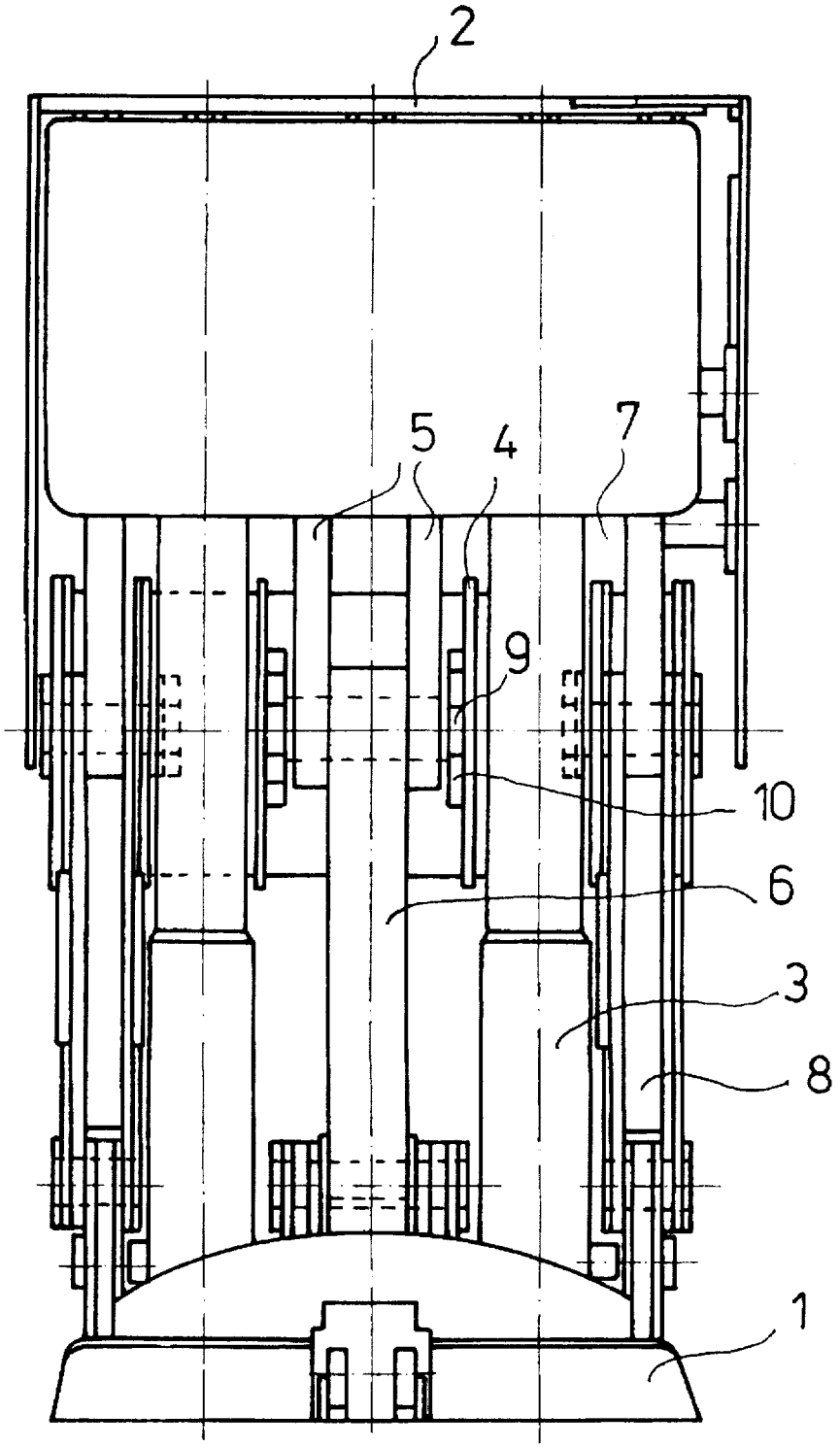

The roof support includes bottom sprag 1, canopy 2 and hydraulic legs 3 connected to the sprag and the canopy by ball joints. A stabilizing-guiding system is in the form of two quadrilateral linkages joined by spacer elements 4. The quadrilateral linkages comprise front links 7, 8 and rear links 7', 8'. The stabilizing-guiding system includes coordinating links 5, 6. The coordinating links 5, 6 are pivotably connected at one of the end thereat to the bottom sprag 1 and at the other ends thereof to canopy 2 by common articulated joints I and II of front links 7 and 8, and at the other ends the links 5, 6 are pivotably connected together by means of a joining element 9 in the form of a pin. The joining element 9 engages longitudinal guideways 10 enabling movement of joining element 9 in relation to the spacer elements 4. The longitudinal guideways 10 are formed as flat sections fixedly connected to the spacer elements 4. The main axis of the guideways 10 is parallel to the bottom sprag base plane 1. The coordinating links 5 and 6 form acute angles $\alpha$ with the front links 7 and 8. The roof support has the hydraulic legs situated in the bottom-sprag in the seat points 11 located from rearwardly of a plane 12 bounding a walkway area on the bottom sprag on the side of the stabilizing-guiding system.

In the support described, the spacer elements 4 are shaped so that the axes of the pivot holes of the front and rear links (not shown ) are located as the vertexes of an isosceles triangle. The roof support is equipped with the standard advancing system.

What is claimed is:

1. A mining roof support comprising:

a canopy, a bottom sprag, and a stabilizing-guiding system for the roof support, said stabilizing-guiding system comprising:

a pair of hydraulic legs connected to said canopy and to said bottom sprag, two articulated quadrilateral linkages respectively connected to said canopy and said bottom sprag;

a spacer element connecting said two quadrilateral linkages together;

said quadrilateral linkages including two front and two rear links;

two coordinating links pivotably connected at first ends thereof, respectively to said canopy and said sprag and at second ends thereof to one another;

a connecting element at said second ends of the coordinating links pivotably connecting said second ends together, a longitudinal guideway for said connecting element, said guideway having a main axis parallel to said bottom sprag, said longitudinal guideway being fixed to said spacer element, said front links being pivotably connected at respective first ends thereof respectively to said canopy and said sprag and at second ends thereof to one another and to said spacer element, said front links and said coordinating links forming an acute angle between one another, said hydraulic legs being connected to said bottom sprag for pivotable movement about an axis located on one side of a vertical plane, bounding a walkway space on the bottom sprag, said stabilizing guiding system also being located on said one side of said vertical plane.

2. A mining roof support as claimed in claim 1, wherein said hydraulic legs extend perpendicularly to said bottom sprag.

3. A mining roof support as claimed in claim 1, wherein said hydraulic legs are also located on said one side of said vertical plane.

4. A mining roof support as claimed in claim 1, wherein said coordinating links are connected pivotably to said sprag for movement about an axis which is coincident with an axis of pivotable connection of said front links and said sprag.

5. A mining roof support as claimed in claim 1, wherein said coordinating links are connected pivotably to said canopy for movement about an axis which is coincident with an axis of pivotable connection of said front links and said canopy.

6. A mining roof support as claimed in claim 1, wherein said front links are pivotably connected together by a pin passing through said spacer element at a first axis and said rear links are connected to said spacer element for pivotable movement about respective second and third axes, said first, second and third axes being located at vertexes of an isosceles triangle.

7. A mining roof support as claimed in claim 1, wherein said hydraulic legs each comprises a hydraulic ram having an upper end pivotably connected to the canopy and a lower end pivotably connected to the sprag.

* * * * *